US006572931B2

(12) United States Patent
Barbezat

(10) Patent No.: US 6,572,931 B2
(45) Date of Patent: Jun. 3, 2003

(54) METHOD OF APPLYING A FERROUS COATING TO A SUBSTRATE SERVING AS A CYLINDER WORKING SURFACE OF A COMBUSTION ENGINE BLOCK

(75) Inventor: Gerard Barbezat, Opfikon (CH)

(73) Assignee: Sulzer Metco AG, Wohlen (CH)

( * ) Notice: Subject to any disclaimer, the term of this patent is extended or adjusted under 35 U.S.C. 154(b) by 0 days.

(21) Appl. No.: 10/001,132

(22) Filed: Oct. 23, 2001

(65) Prior Publication Data

US 2002/0051851 A1 May 2, 2002

Related U.S. Application Data

(62) Division of application No. 09/476,009, filed on Dec. 29, 1999.

(30) Foreign Application Priority Data

Jan. 19, 1999 (CH) ..... 0091/99
Feb. 9, 1999 (CH) ..... 0245/99

(51) Int. Cl.[7] ..... C23C 4/06
(52) U.S. Cl. ..... 427/453; 427/456; 427/451
(58) Field of Search ..... 427/454, 452, 427/455, 456, 451, 453

(56) References Cited

U.S. PATENT DOCUMENTS 3,935,797 A 2/1976 Niimi et al.
4,060,653 A * 11/1977 O'Day et al. ..... 427/447
5,466,906 A 11/1995 McCune, Jr. et al.
5,592,927 A 1/1997 Zaluzec et al.
5,622,753 A 4/1997 Shepley et al.
5,649,994 A * 7/1997 Holko ..... 228/262.31
5,663,124 A 9/1997 Rao et al.
5,723,187 A * 3/1998 Popoola et al. ..... 427/310
5,766,693 A 6/1998 Rao

FOREIGN PATENT DOCUMENTS

DE 940082 3/1956
FR 735928 11/1932

OTHER PUBLICATIONS

Thermal Spraying: Practice, Theory, and Application, American Welding Society, Inc., 1985, p. 57.*

* cited by examiner

*Primary Examiner*—Katherine A. Bareford
(74) *Attorney, Agent, or Firm*—Tarolli, Sundheim, Covell & Tummino L.L.P.

(57) ABSTRACT

To improve the machining and processing, respectively, as well as the tribologic properties of ferrous coatings for the working surfaces of combustion engine cylinder blocks applied by a plasma spraying operation, a ferrous coating having a content of bound oxygen in the amount of between 1 to 4% by weight is suggested. Such coatings can be realized, for example, by adding an amount of 200 to 1000 normalized liters air per minute during the plasma spraying operation.

19 Claims, 2 Drawing Sheets

METHOD OF APPLYING A FERROUS COATING TO A SUBSTRATE SERVING AS A CYLINDER WORKING SURFACE OF A COMBUSTION ENGINE BLOCK

RELATED APPLICATIONS

This application is a divisional of co-pending U.S. patent application Ser. No. 09/476,009, filed on Dec. 29, 1999 which claims priority of Swiss Application Nos. 1999 0091/99, filed Jan. 19, 1999 and 1999 0245/99, filed Feb. 9, 1999.

BACKGROUND OF THE INVENTION

The present invention refers to a method of applying a ferrous coating to a substrate serving as a cylinder working surface of a combustion engine block.

PRIOR ART

In the prior art, the traditional material for the working surfaces of the cylinders of combustion engine blocks that are made of aluminum or magnesium alloy is constituted by grey cast iron or cast iron blended with compacted graphite. Thereby, cylinder sleeves made of such cast iron are pressed or cast into these combustion engine blocks.

By providing such cylinder sleeves, however, on the one hand the size and the weight of the engine block is influenced in a negative sense. On the other hand, an inconvenient or adverse connection between the cylinder sleeves made of cast iron and the engine block made of a light metal alloy must be taken into account. Alternatively, also coatings applied by a galvanizing process have been used. However, the application of such coating is expensive and, moreover, such coatings may corrode under the influence of sulfuric acid and formic acid.

Furthermore, the application of a coating to bores in general by means of a plasma spraying operation is known in the art for a long time. Thereby, a variety of metallic materials can be applied to the substrate. Once the coating has been applied by means of the plasma spraying operation, the bores are further processed by diamond honing to reach their desired final diameter and provided with the desired topography. The ability of the coating to be processed and machined, respectively, and the tribologic properties are depending to a high degree on the microstructure and the physical properties of the particular coating.

OBJECTS OF THE INVENTION

It is an object of the present invention to improve the machining and processing, respectively, as well as the tribologic properties of ferrous coatings for the working surfaces of combustion engine cylinder blocks applied by a plasma spraying operation.

SUMMARY OF THE INVENTION

In order to meet this and other objects, the invention provides a method of applying a ferrous coating to a substrate serving as a cylinder working surface of a combustion engine block. The method comprises the steps of providing a plasma spraying apparatus, providing a coating powder constituting the raw material of the coating to be applied, spraying the coating powder by means of the plasma spraying apparatus onto the cylinder working surface; and either supplying air to the plasma spraying apparatus and spraying the air simultaneously with the coating powder onto the substrate in an amount of between 200 and 1000 normalized liters per minute; or supplying an oxygen containing gas to the plasma spraying apparatus and spraying the oxygen containing gas simultaneously with the coating powder onto the substrate in an amount of between 40 and 200 normalized liters oxygen per minute; or supplying oxygen to the plasma spraying apparatus and spraying the oxygen simultaneously with the coating powder onto the substrate in an amount of between 40 and 200 normalized liters per minute.

The expression "normalized liters per minute" shall be understood as "liters per minute at an ambient pressure of 1 bar ($=10^5$ Pa) and a temperature of 20° C. Preferably, the velocity of the gas flow in the interior of the sleeve or cylinder bore amounts to between 7 and 12 m/s during the plasma spraying operation.

In a preferred embodiment, a gas atomized powder is plasma sprayed to the substrate, whereby the powder has the following composition:

C=0.4 to 1.5% by weight

Cr=0.2 to 2.5% by weight

Mn=0.02 to 3% by weight

P=0.01 to 0.1% by weight, if appropriate

S=0.01 to 0.2% by weight, if appropriate

Fe=difference to 100% by weight.

In another preferred embodiment, a gas atomized powder is plasma sprayed to the substrate, whereby the powder has the following composition:

C=0.1 to 0.8% by weight

Cr=11 to 18% by weight

Mn=0.1 to 1.5% by weight

Mo=0.1 to 5% by weight

S=0.01 to 0.2% by weight, if appropriate

P=0.01 to 0.1% by weight, if appropriate

Fe=difference to 100% by weight.

The amount of FeO and $Fe_3O_4$ in the coating can be influenced by the distribution of the size of the particles of the powder. Depending on the coating to be realized, the size of the particles of the powder can be in the region of between 5 to 25 $\mu$m, in the region of between 10 to 40 $\mu$m, or in the region of between 15 to 60 $\mu$m. The size of the particles can be determined by means of an optical or an electronic microscope, particularly by means of a scanning microscope, or according to the laser diffraction method MICROTRAC.

Preferably, a coating powder is used that has been gas atomized by means of argon or nitrogen.

The best results can be obtained if a coating powder is used that is blended with a tribologic oxide ceramics. Preferably, the oxide ceramics consists of $TiO_2$ or $Al_2O_3TiO_2$ and/or $Al_2O_3ZrO_2$ alloy systems. The portion of the oxide ceramics in the coating powder can amount to between 5 and 50% by weight.

It should be noted that the optimum particle size is selected according to the tribologic properties of the coating to be applied and according to the mechanical behavior of the substrate to which the coating has to be applied.

BRIEF DESCRIPTION OF THE DRAWINGS

In the following, some examples of a coating according to the invention will be further described. In the accompanying drawings.

EXAMPLE 1

Figure 1:
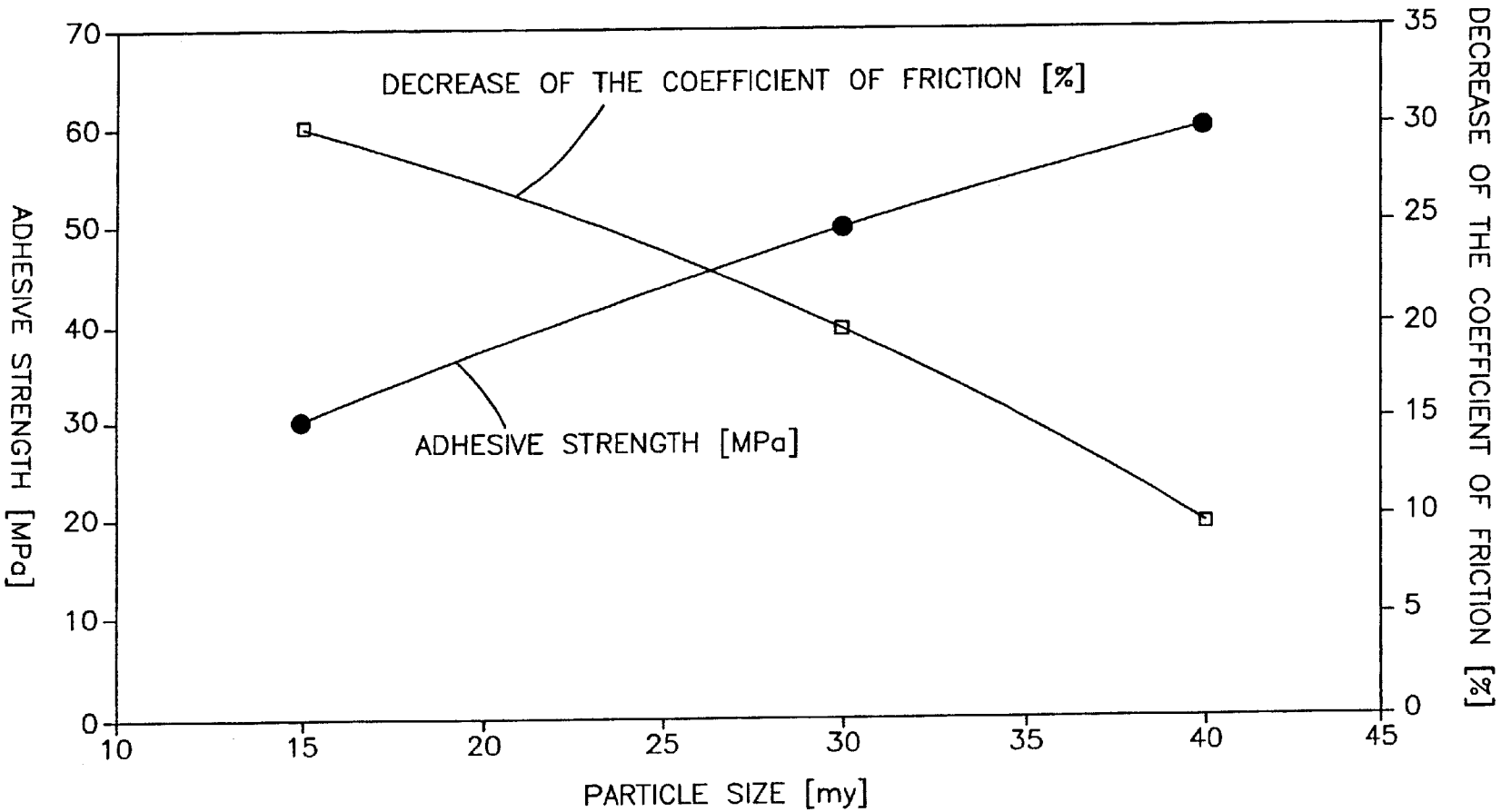
FIG. 1 shows a diagram illustrating the relation between the particle size of the coating powder and the decrease of the coefficient of friction as well as the relation between the particle size of the coating powder and the mechanical characteristics, particularly the adhesive strength of the coating.

A coating powder has been applied to the working surface of a cylinder sleeve of a combustion engine by means of a plasmatron. The coating powder had the following composition:

C=1.1% by weight

Cr=1.5% by weight

Mn=1.5% by weight

Fe=difference to 100% by weight.

If appropriate, the coating powder may also contain S and P in small amounts (i.e. 0.01 to 0.2% by weight).

The size of the particles of the coating powder was between 5 and 25 $\mu$m. The powder has been manufactured by a gas atomizing process. The velocity of the gas flow during the operation of applying the coating was 10 m/s, and the amount of air fed to the plasmatron for cooling the coating and for the reaction of the powder was 500 NLPM (normalized liters per minute). This corresponds to about 100 NLPM pure oxygen. That amount of air was fed through the body of a plasmatron well known in the art, e.g. as described in U.S. Pat. No. 5,519,183.

The results of the experiments that have been run have shown that the content of oxygen in the applied coating was in the region of 3% by weight. According to a macro structural analysis performed by means of X-rays, the oxygen is bound according to the stoichiometric formulas FeO and $Fe_3O_4$. Moreover, that analysis has shown that the presence of $Fe_2O_3$ is below the detectable limit.

The coating having been applied, the cylinder sleeve was further processed by diamond honing. Experiments with a combustion engine provided with such cylinder sleeves have clearly confirmed that the coefficient of friction between the piston rings and the wall of the cylinder sleeve is substantially reduced, as compared to well known cylinder sleeves made of grey cast iron.

EXAMPLE 2

A powder was used having the same composition as in Example 1 herein before, but with a particle size of between 10 and 45 $\mu$m. Moreover, all other conditions were identical to the ones described in Example 1. Thereby, it was found that the content of bound oxygen in the applied coating was in the region of 2% by weight. The other results of an analysis of the coating were the same as explained in connection with Example 1.

The coating having been applied, the cylinder sleeve was further processed by diamond honing. Experiments with a combustion engine provided with such cylinder sleeves have clearly confirmed that the coefficient of friction between the piston rings and the working surface of the cylinder sleeve again is substantially reduced, as compared to well known cylinder sleeves made of grey cast iron, whereby the reduction of the coefficient of friction is in relation to the amount of bound oxygen.

EXAMPLE 3

Cylinder sleeves that are to be used with combustion engines operated with sulphurous fuel or with methanol, such engines being subject to corrosion when they are operated at temperatures below the dew-point at the given conditions, have been coated, under the same conditions as described in Example 1, with a powder having the following composition:

C=0.4% by weight

Cr=13.0% by weight

Mn=1.5% by weight

Mo=2.0% by weight

Fe=difference to 100% by weight.

If appropriate, the coating powder may also contain S and P in small amounts (i.e. 0.01 to 0.2% by weight).

The size of the particles of the coating powder was between 10 and 45 $\mu$m.

The tests that have been run using such a coating yielded substantially the same favorable results as explained in Examples 1 and 2.

EXAMPLE 4

The same procedure was performed as described in Example 2, except that 30% by weight of an ceramics alloy powder was added to the coating powder, the ceramics alloy powder having a composition of 60% by weight $Al_2O_3$ and 40% by weight $TiO_2$The coatings created using such a powder are mechanically reinforced due to the inclusion of the ceramics particles with a size of between 5 and 22 $\mu$m.

EXAMPLE 5

The same procedure was repeated as described in Example 4, except that 30% by weight of a ceramics alloy powder was added to the coating powder, the ceramics alloy powder having a composition of 80% by weight $Al_2O_3$ and 20% by weight $TiO_2$. The coatings created using such a powder are mechanically reinforced due to the inclusion of the ceramics particles with a size of between 5 and 22 $\mu$m.

FIG. 1 shows a diagram illustrating the relation between the particle size of the coating powder and the decrease of the coefficient of friction as well as the relation between the particle size of the coating powder and the mechanical characteristics, particularly the adhesive strength of the coating. It is evident from the diagram, on the one hand, that the coefficient of friction gets lower if the size of the particles is increased. On the other hand, the adhesive strength is gradually reduced if the particle size is increased. A good compromise may be a particle size in the region of 25 to 30 $\mu$m, whereby the adhesive strength amounting to appr. 45–50 MPa should be sufficient in most cases while the coefficient of friction is still reduced, as compared to the prior art coatings, by about 22–25%. However, if adhesive strength is the primary goal and the reduction of the coefficient of friction is but of secondary importance, one would chose a coating powder having particles with a smaller size. In another application, in which the reduction of the coefficient of friction is the primary goal and the adhesive strength of the coating is less important, one would chose a coating powder having particles with a greater size.

Figure 2:
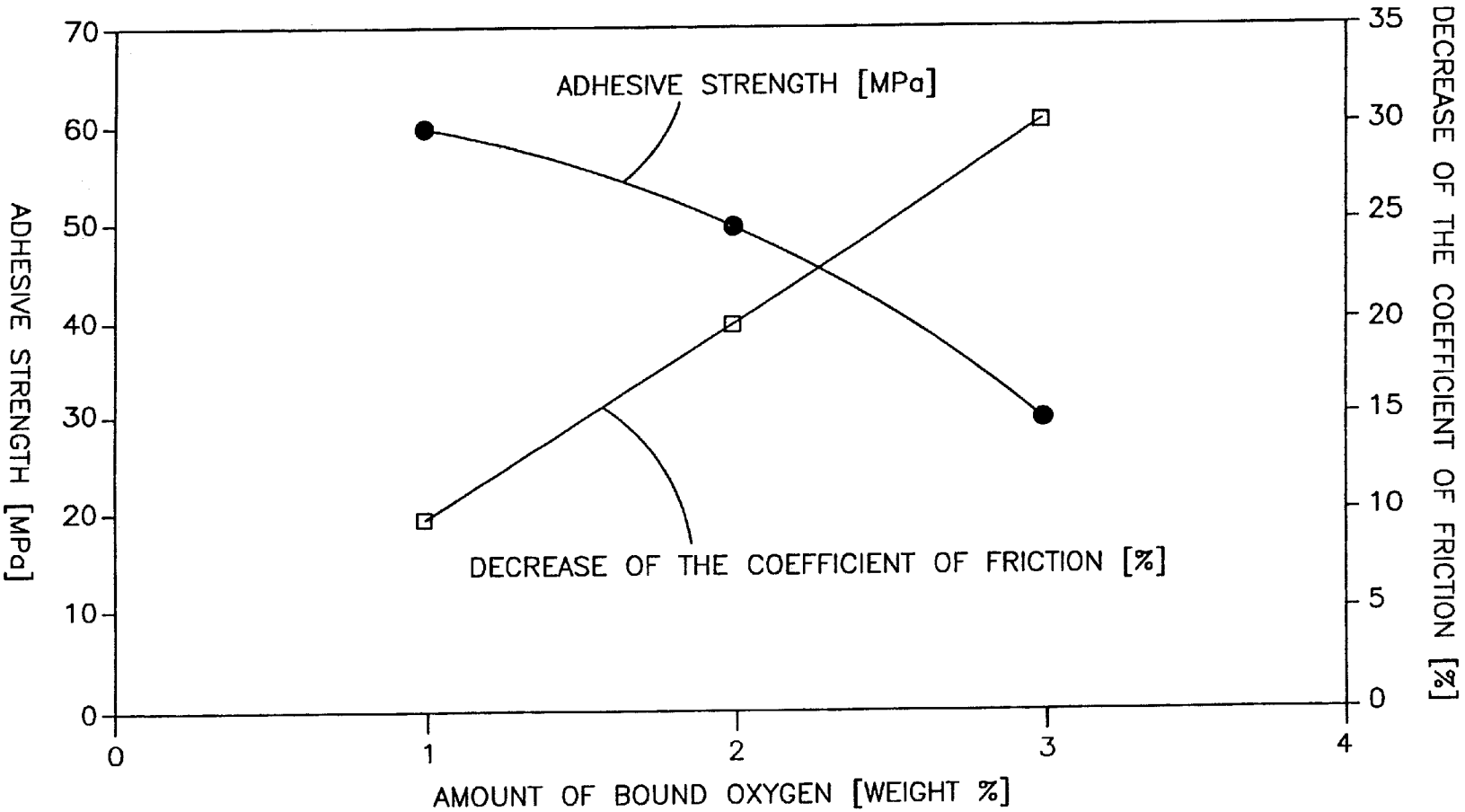
FIG. 2 shows a diagram illustrating the relation between the amount of bound oxygen in the coating and the decrease of the coefficient of friction as well as the relation between the amount of bound oxygen in the coating and the mechanical characteristics, particularly the adhesive strength of the coating.

FIG. 2 shows a diagram illustrating the relation between the amount of bound oxygen in the coating and decrease of the coefficient of friction as well as the relation between the amount of bound oxygen in the coating and mechanical characteristics, particularly the adhesive strength of the coating. It is evident from the diagram, on the one hand, that the coefficient of friction gets lower if the amount of bound oxygen in the coating is increased. On the other hand, the adhesive strength is reduced if the amount of bound oxygen in the coating is increased. A good compromise may be a content of bound oxygen in the region of between 2–2.5% by weight, whereby the adhesive strength amounting to appr. 40–50 MPa should be sufficient in most cases while the coefficient of friction is still reduced, as compared to the prior art coatings, by about 20–25%. Correspondingly to what is explained in connection with FIG. 1, i.e. if adhesive strength is the primary goal and the reduction of the coefficient of friction is but of secondary importance, one would strive for realizing a lower content of bound oxygen in the coating. In another application, in which the reduction of the coefficient of friction is the primary goal and the adhesive strength of the coating is less important, one would strive for realizing a higher content of bound oxygen in the coating.

What is claimed is:

1. A method of applying a ferrous coating to a substrate serving as a cylinder working surface of a combustion engine block, the method comprising the steps of:

providing a plasma spraying apparatus;

providing a coating powder constituting the raw material of said coating to be applied;

spraying said coating powder by means of said plasma spraying apparatus onto said cylinder working surface; and supplying air to said plasma spraying apparatus and spraying said air simultaneously with said coating powder onto said substrate in an amount of between 200 and 1000 normalized liters per minute;

the velocity of gas flow during the spraying step being between 7 and 12 rn/s.

2. A method according to claim 1 wherein said substrate includes a cylinder bore and a cylinder sleeve, said cylinder bore and said cylinder sleeve defining the cylinder working surface, and wherein the velocity of gas flow inside of the cylinder bore and the cylindrical sleeve being between 7 and 12 m/s during said spraying step.

3. A method according to claim 1 in which a gas atomized powder is plasma sprayed to said substrate, said powder having the following composition:

C=0.4 to 1.5% by weight

Cr=0.2 to 2.5% by weight

Mn=0.02 to 3% by weight balance of the composition Fe.

4. A method according to claim 1 in which a gas atomized powder is plasma sprayed to said substrate, said powder having the following composition:

C=0.4 to 1.5% by weight

Cr=0.2 to 2.5% by weight

Mn=0.02 to 3% by weight

S=0.01 to 0.2% by weight

P=0.01 to 0.1% by weight balance of the composition Fe.

5. A method according to claim 1 in which a gas atomized powder is plasma sprayed to said substrate, said powder having the following composition:

C=0.1 to 0.8% by weight

Cr=11 to 18% by weight

Mn=0.1 to 1.5% by weight

Mo=0.1 to 5% by weight balance of the composition Fe.

6. A method according to claim 1 in which a gas atomized powder is plasma sprayed to said substrate, said powder having the following composition:

C=0.1 to 0.8% by weight

Cr=11 to 18% by weight

Mn=0.1 to 1.5% by weight

Mo=0.1 to 5% by weight

S=0.01 to 0.2% by weight

P=0.01 to 0.1% by weight balance of the composition Fe.

7. A method according to claim 1 in which the amount of FeO and $Fe_3O_4$ in the coating is controlled by the distribution of the size of the particles of the powder.

8. A method according to claim 7, in which the size of the particles of the powder is between 5 to 25 $\mu$m.

9. A method according claim 7, in which the size of the particles of the powder is between 10 to 40 $\mu$m.

10. A method according to claim 7, in which the size of the particles of the powder is between 15 to 60 $\mu$m.

11. A method according to claim 1 in which a coating powder is used that has been gas atomized by means of argon or nitrogen.

12. A method according to claim 1 in which a coating powder is used that has been modified by an addition of a tribologic oxide ceramic.

13. A method according to claim 12 in which the content of said oxide ceramic in the coating powder amount to between 5 and 50% by weight.

14. A method according to claim 12 in which said oxide ceramic consists of $TiO_2$ alloy systems.

15. A method according to claim 12 in which said oxide ceramic consists of $Al_2O_3TiO_2$ alloy systems.

16. A method according to claim 12 in which said oxide ceramic consists of $Al_2O_3ZrO_2$ alloy systems.

17. A method according to claim 12 in which said oxide ceramic consists of $Al_2O_3TiO_2$ and $Al_2O_3ZrO_2$ alloy systems.

18. A method of applying a ferrous coating to a substrate serving as a cylinder working surface of a combustion engine block, the method comprising the steps of:

providing a plasma spraying apparatus;

providing a coating powder constituting the raw material of said coating to be applied;

spraying said coating powder by means of said plasma spraying apparatus onto said cylinder working surface; and supplying an oxygen containing gas to said plasma spraying apparatus and spraying said oxygen containing gas simultaneously with said coating powder onto said substrate in an amount of between 40 and 200 normalized liters oxygen per minute;

the velocity of gas flow during the spraying step being between 7 and 12 m/s.

19. A method of applying a ferrous coating to a substrate serving as a cylinder working surface of a combustion engine block, the method comprising the steps of:

providing a plasma spraying apparatus;

providing a coating powder constituting the raw material of said coating to be applied;

spraying said coating powder by means of said plasma spraying apparatus onto said cylinder working surface; and supplying oxygen to said plasma spraying apparatus and spraying said oxygen simultaneously with said coating powder onto said substrate in an amount of between 40 and 200 normalized liters per minute;

the velocity of gas flow during the spraying step being between 7 and 12 m/s.

* * * * *